United States Patent [19]

Kent et al.

[11] Patent Number: 4,923,049

[45] Date of Patent: May 8, 1990

[54] WING EXTENSION FOR ROOF LADDER

[76] Inventors: Edward C. Kent, P.O. Box 538, Bonita Springs, Fla. 33959; Charles E. Long, 9691 Alabama St., Bonita Springs, Fla. 33923

[21] Appl. No.: 330,281

[22] Filed: Mar. 29, 1989

[51] Int. Cl.[5] ..... E06C 1/36

[52] U.S. Cl. ..... 182/45; 182/107

[58] Field of Search ..... 182/45, 206, 107, 194; 248/210

[56] References Cited

U.S. PATENT DOCUMENTS

| | | | |
|---|---|---|---|
| 680,428 | 8/1901 | Carryl | 182/206 X |
| 3,059,723 | 10/1962 | Shore | 182/107 |
| 4,279,327 | 7/1981 | Warren | 182/45 X |
| 4,311,207 | 1/1982 | Lurry | 182/107 X |
| 4,445,659 | 5/1984 | LaChance | 248/210 |
| 4,519,477 | 5/1985 | Ralston | 182/107 |
| 4,531,613 | 7/1985 | Keigher | 182/45 X |

*Primary Examiner*—Ramon S. Britts
*Assistant Examiner*—Karen J. Chotkowski
*Attorney, Agent, or Firm*—William F. Hamrock

[57] ABSTRACT

The invention is directed to a portable wing extension for releasably securing to a roof ladder. The wing extension includes a horizontal wing section secured to slide through supports which are received within adjacent rungs of the ladder. A pair of lock pins releasably secure the wing extensions to the ladder. Wing extensions can be attached to either or both sides of the ladder. The attached wing extensions permit a firefighter to safely cut a ventilation hole in a roof beyond the width of the ladder at any location on the roof.

9 Claims, 2 Drawing Sheets

WING EXTENSION FOR ROOF LADDER

BACKGROUND OF THE INVENTION

1. Field of Invention

The invention is directed to portable wing extensions for roof ladders, or similar ladders used on inclined surfaces, and in particular for roof ladders used by firefighters or other workers where some chore beyond the normal width of the ladder must be performed.

2. Description of the Prior Art

In the past, conventional roof ladders used by firefighters included hooks attached to the top of the ladder which hooked over the peak of the roof to secure the ladder to the roof. In fighting a building fire, the firefighters would climb part way up the roof ladder and while leaning over on one side would cut a ventilation hole in the roof using the proper tools.

More recently roof ladders having spread apart upper rails have been provided. These ladders are disclosed in U.S. Pat. No. 4,279,327 to Warren issued July 21, 1981 and U.S. Pat. No. 4,531,613 to Keigher issued on July 30, 1985. In each of these patents the bottom bar of the spread apart upper rails is firmly secured to the top of the ladder while the tops of the side bars have hooks attached thereto which hook over the peak of the roof. Thus, when a ventilation hole is to be cut in the roof while using the spread apart upper rails, the location of the hole is limited to the roof area at the peak of the roof because of the location of the spread apart upper rails.

The prior art roof ladders all suffer major disadvantages. Conventional roof ladders having hooks attached to the top of the ladders requiring firefighters to lean over to one side in cutting a ventilation hole are extremely unsafe.

With respect to roof ladders having the spread apart rails as discussed above, there are serious limitations to their use. A major limitation in having the spread apart rails at the top of the ladder is that the ventilation hole must be cut only at the peak of the roof and between the side bars of the apparatus because that is the only area which can safely support a firefighter. However, in numerous situations, the ventilation hole is required not at the peak but elsewhere on the roof. A further disadvantage is the suitable positioning on the roof of this ladder and attached spread apart rails. Since the spread apart rails are firmly secured to the top of the ladders, it can result in an extremely cumbersome operation in hoisting this ladder with rails and hooks up and over the peak of the roof.

The present invention solves the problems and shortcomings of the prior art by providing one or more portable wing extensions which can be inserted through the rungs of a conventional roof ladder at various height levels.

SUMMARY OF THE INVENTION

It is an object of the present invention to provide portable wing extensions for a roof ladder which will safely support a person or persons working on either side of the ladder.

It is a further object to provide a portable wing extension which can be secured to a roof ladder at various heights.

It is another object to provide portable wing extensions which can be secured on each side of the ladder at different height levels.

It is another object to provide portable wing extensions which can be attached to each side of the roof ladder so that the stability of the ladder on the roof is greatly increased.

It is another object of the invention to provide portable extensions that can be easily secured to the ladder after the ladder has been placed on the roof.

The above objects are met with the present portable wing extensions.

DETAILED DESCRIPTION OF THE PREFERRED EMBODIMENT

Figure 1:
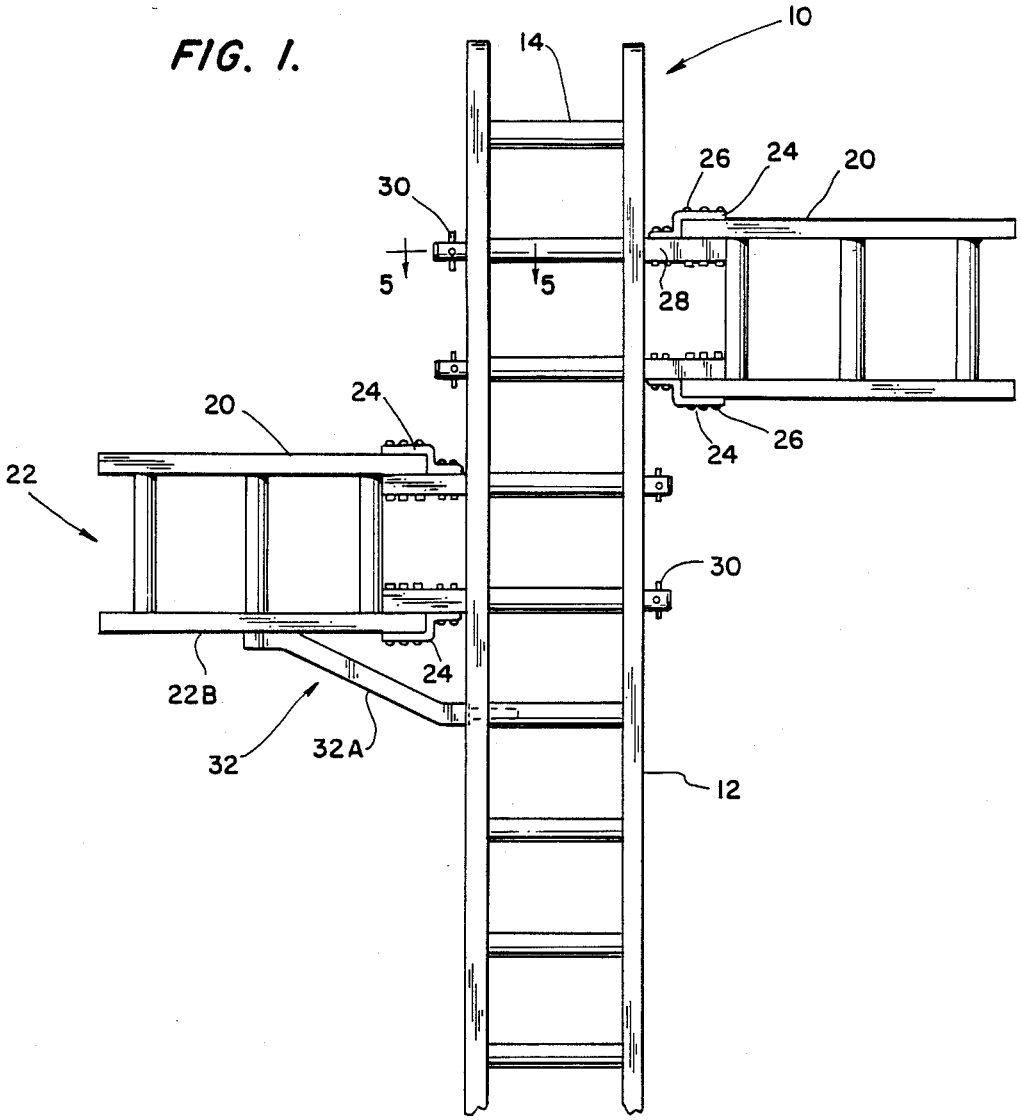
FIG. 1 is a front fragmentary view of a ladder with wing extensions in place.

FIG. 1 illustrates an overall view of the invention. There is shown a fragmentary view of roof ladder 10 with two portable wing extensions 20 attached at different levels on either side of the ladder.

Figure 4:
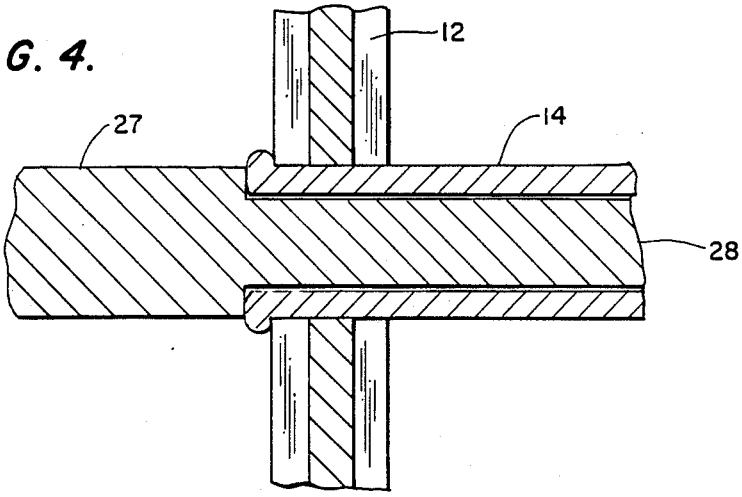
FIG. 4 is a fragmentary view of the abutment of the exterior flanged section of the slide through support and the rung and ladder beam.

The ladder includes ladder beams 12 and a plurality of rings 14. The ladder is intended to be a conventional aluminum or similar type ladder with hollow openings through the rungs. The many details of this view are not shown since they are relevant to the design of the ladder. Conventional ladders usually have circular hollow openings through the rungs which will easily accommodate a snugly fitted circular slide through support. The rung can extend beyond the beam as shown in FIG. 4 or be an internal fitting similar to that shown in FIGS. 2 and 5. However, other configurations are applicable as long as they will accommodate the snugly fitted slide through support of the invention.

Figure 3:
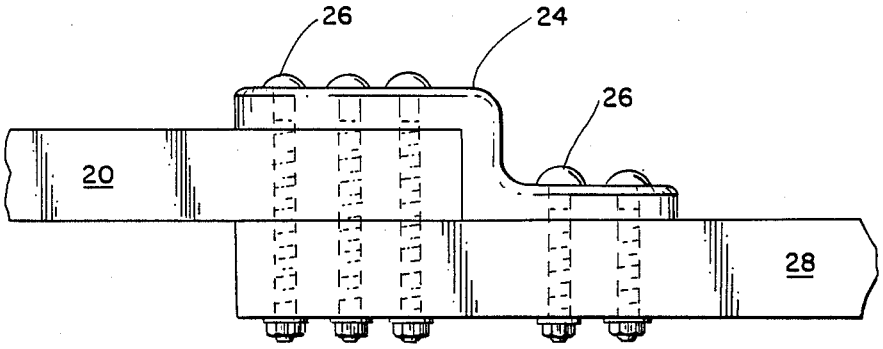
FIG. 3 is an enlarged fragmentary view of the ladder beam and slide through support attached to a sleeve clamp.

The portable wing extension is indicated generally by numeral 20 and includes a wing section 22 which is securely attached to slide through support 28 by sleeve clamp 24 and bolts 26. The wing section is about four feet in length but can be any appropriate length suitable to the design of the ladder. The wing section includes a pair of horizontally spaced apart parallel beams and about three vertically spaced apart parallel rungs. One end of the wing section beams is secured to sleeve clamps 24 as shown in FIGS. 1 and 3 or by other securing means such as welding.

Figure 2:
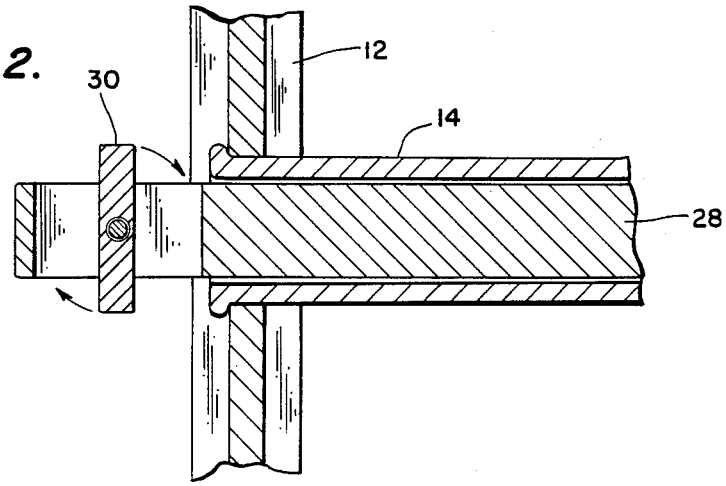
FIG. 2 is a sectional view of the free fall lock in place taken along 2—2 of FIG. 5.
Figure 5:
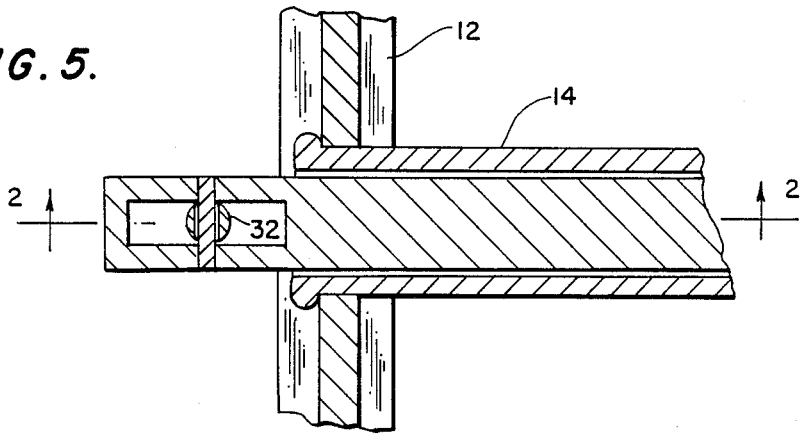
FIG. 5 is a sectional view along lines 5—5 of FIG. 1.

The slide through supports 28 are sized to be received snugly within the rungs of the conventional ladder as shown in FIGS. 2, 4 and 5. Usually, the slide through supports are of circular shape but they may be of any shape and size which fits snugly within conventional ladder rungs 14. A further embodiment is shown in FIG. 4 whereby the exterior flanged section of the slide through support abuts the rung and ladder beam.

The slide through supports 28 fit within the ladder rungs and usually overlap the same by a few inches as shown in FIGS. 1, 2 and 5. It is essential that the slide through supports be easily and releasably secured to the ladder for ready attachment and removal of the portable wing extension. This is accomplished through use of lock pin 30. It allows the slide through support to be slid into and through ladder rungs 14 and to be securely locked in place. It further permits the slide through supports to be easily disengaged by lifting out the lock pins.

Another embodiment of the invention includes replacing the slide through bar with a quick release mechanism which could be attached to a rung or beam of the ladder. Such a mechanism could be easily released to disengage the wing extension.

The importance of these features of the invention is that the portable wing extension can be easily attached to the ladder after the ladder has been placed on the roof or other inclined surface. This is particularly important in fighting building fires where it is not clear where the ventilation hole is to be cut in the roof.

It is also of paramount importance wherein portable wing extensions can be secured to different sides of the ladder at various heights and locations for whatever reason. Not only does this double wing construction increase the stability of the ladder on the roof but it also enhances the safety of the operation by preventing the conventional ladder from falling through the roof in case of the roof collapsing. Conventional roof ladders are usually about 18 inches wide while most roof trusses are 24 inches wide which would not prevent the conventional ladder from falling through the wide space between roof trusses. One or two wings attached to the ladder would prevent it from falling through these roof trusses.

An additional feature of the invention is the optional brace 32 as shown in FIG. 1. The brace as shown is removably attached to a lower beam 22B of the wing section 22. Said brace includes a downward inclined brace bar 32A which is sized to snugly fit a short distance within the adjacent lower rung as shown. The brace can be easily attached to the ladder wing section while the ladder is on the roof. Although the optional brace as shown is attached only to the lower wing extension, each wing extension can be attached likewise to the ladder with an optional brace.

There are also many more advantages to the use of the portable wing extensions of this invention for both commercial and residential use. It is seen then that the invention provides a substantially improved portable wing extension not possible or known with prior art devices. It is further evident that the wing extensions can be secured to the roof ladder prior to use. This operation would permit the user to secure the wing extensions to the ladder and then place it on the roof. Likewise, the wing extensions can be permanently attached to the roof ladder. Here, this slide through bar could be permanently attached to a rung or a beam of the ladder by welding or securing means.

While certain novel features of this invention have been shown and described, it will be understood that various changes in the forms and details of the device illustrated and in its operation can be made by those skilled in the art without departing from the spirit of the invention.

What is claimed is:

1. A portable wing extension for a roof ladder comprising a horizontal wing section having a pair of horizontally spaced parallel beams connected by vertically spaced parallel rungs, one end of said beams securely attached to a pair of horizontally spaced parallel slide through supports, said slide through supports adaptable to be received by a pair of parallel rungs of said ladder, releasable securing means for releasably securing said slide through supports to one side of of said ladder.

2. A wing extension according to claim 1 wherein said slide through supports are adaptable to be received within said parallel rungs of said ladder.

3. A wing extension according to claim 2 wherein said slide through supports are adaptable to pass completely through said parallel rungs of said ladder.

4. A wing extension according to claim 3 wherein said slide through supports having a flanged section which is adpatable to abut said parallel rungs of said ladder.

5. A wing extension according to claim 3 wherein said releasable securing means comprises a pair of lock pins.

6. A portable wing extension according to claim 1 having a brace member and a means for removably attaching the brace to said wing extension and a means for extending through a ladder rung.

7. A portable wing extension according to claim 6, wherein said brace member comprises a downwardly inclined brace bar.

8. A roof ladder having at least one portable wing extension of claim 1 attached thereto.

9. A roof ladder according to claim 8 wherein at least one portable wing is attached to each side of said ladder.

* * * * *